United States Patent [19]

Westelaken

[11] 4,086,708

[45] May 2, 1978

[54] GRAIN DRYER

[75] Inventor: Christianus M. T. Westelaken, St. Marys, Canada

[73] Assignee: Westlake Agricultural Engineering Inc., St. Marys, Canada

[21] Appl. No.: 770,048

[22] Filed: Feb. 18, 1977

Related U.S. Application Data

[63] Continuation-in-part of Ser. No. 601,867, Aug. 4, 1975, abandoned.

[51] Int. Cl.[2] ..... F26B 7/00

[52] U.S. Cl. ..... 34/65; 34/86; 34/170; 34/174

[58] Field of Search ..... 34/13, 22, 35, 86, 165, 34/168, 169, 170, 174, 175, 177, 65, 66, 167

[56] References Cited

U.S. PATENT DOCUMENTS

| | | | |
|---|---|---|---|
| 2,626,205 | 1/1953 | Watson | 34/170 |
| 3,112,188 | 11/1963 | Zehnder | 34/169 |
| 3,710,449 | 1/1973 | Rathbun | 34/165 |
| 3,757,427 | 9/1973 | Wilkinson | 34/72 |

FOREIGN PATENT DOCUMENTS

| | | | |
|---|---|---|---|
| 862,851 | 11/1952 | Germany | 34/170 |

*Primary Examiner*—Kenneth W. Sprague
*Assistant Examiner*—James C. Yeung

[57] ABSTRACT

A concurrent-countercurrent flow type grain dryer is described having an improved wet grain-hot air contacting arrangement. The dryer includes a wet grain bin having a horizontal floor assembly with a plurality of uniformly spaced openings with a tube member extending downwardly beneath each such opening. These tubes have insulated side walls and serve to deliver wet grain in response to gravity from the bin into a drying chamber. A hot air inlet duct is provided adjacent the tube members to deliver hot air into the space between the tube members and downwardly through a bed of grain in the drying chamber. The bottom of the drying chamber has metering grain outlets as well as cooling air inlet ducts, while air exhaust duct are provided intermediate the hot and cooling air inlets. The novel floor assembly permits the wet grain to be cyclically delivered into the drying chamber with a pulsating action, which causes a lateral flow resulting in uniform layers of wet grain being deposited in the drying chamber, where it comes into contact with the hot air.

13 Claims, 17 Drawing Figures

GRAIN DRYER

This invention relates to an improvement in grain dryers of the concurrent-countercurrent flow type and is a continuation-in-part of application Ser. No. 601,867, filed Aug. 4, 1975, abandoned.

BACKGROUND OF THE INVENTION

1. Field of the Invention
2. Summary of the Prior Art

It is frequently necessary to dry grain before it is stored. Otherwise, the moisture content of the grain may cause discolouration and spoilage during storage.

This need to dry grain prior to storage has long been recognized and many systems have been developed over the years for this purpose. In many of these prior systems, grain is heated quickly to a maximum temperature and then quickly cooled by exposure to air. One of the most difficult problems associated with this type of system has been that the quick temperature changes have tended to result in stress cracking and shattering of the grain. This, of course, greatly lowers the value of the grain such that it may not even be considered acceptable to many grain elevators and processors.

Many systems have been developed over the years which are intended to heat and dry the grain uniformly while at the same avoiding the problems of stress cracking. One such system is the cross-flow column type grain dryer in which air is transversely forced through the downwardly moving grain in an attempt to evaporate moisture. However, with this type of dryer, great difficulty is encountered in trying to provide a uniform air flow and heating path and generally the grain has been dried very unevenly by this type of system.

Counter flow drying systems have also been widely used in which drying air is forced through the grain in a direction opposite to the direction of grain travel. Of course, with this system the dried grain at the bottom of the bin is is exposed to the hottest air and the wet grain at the top is exposed to cooler air. While this is the most efficient drying method now available, it does have the rather serious problem that some of the grain is overdried, resulting in cracking of the kernels and lowering of quality.

A more recent development which is proving to be quite successful is the concurrent-countercurrent flow grain dryer in which hot drying air travels downwardly in the same direction as the flowing grain and a countercurrent flow of cooling air travels in a direction opposite to the direction of the grain travel. With this system, air exhaust means are provided intermediate the hot air inlet and cooling air inlet. It will be seen that with this system, the hottest air is used at the point where it is of greatest value, i.e. where the grain is wettest and coolest, and as the two travel together, the air heats and dries the grain while the grain gradually cools the air. The counter flow of cooling air serves to further cool and temper the grain before it reaches the grain outlet at the bottom of the bin.

One of the earliest concurrent-countercurrent grain dryers is described in Oholm U.S. Pat. No. 2,706,343. However, the Oholm system has the disadvantage of presenting a V-shaped grain surface area exposed to the entering hot air. This V-shaped surface area of the grain bed results from the grain falling free from a feed spout into a pile having sloping conical sides. Thus, the length of time that individual particles are exposed directly to the hot air will vary according to the particle position on the pile, with those embedded near the peak of the pile being exposed for a shorter period than those embedded on the side slopes.

In prior practice in order to arrive at some practical acceptable average moisture level for most of the grain flowing through the bed, it has been necessary to over dry at least some of the grain.

An effort to overcome such a problem is described in Anderson, Canadian Pat. No. 940,295 in which a means is provided by which grain to be dried is periodically introduced to the drying bed and evenly spread over the entire area of the hot air inflowing end of the bed, as in successive flat layers, without exposing the wet grain being added to the heated dry air until the wet grain being added has been deposited on the bed.

This system has been found to operate extremely well but commercially has the difficulty of being expensive to contruct because of the provision of a plurality of movable sweeps which are used for evenly distributing the incoming wet grain across the drying bed.

It is, therefore, the object of the present invention to provide a simplified system which is less expensive to construct and maintain and which will cyclically distribute wet grain as a layer over the inflowing end of the bed without exposing the wet grain to the heated air until it has been deposited on the bed.

SUMMARY OF THE INVENTION

Thus, the present invention relates to a concurrent-countercurrent flow grain dryer in the form of a tower with side walls, a top and a bottom. This tower has a wet grain receiving bin at the top and wet grain is delivered from the receiving bin in response to gravity into a drying chamber. The drying chamber includes an air space at the top into which heated air is fed and passed downwardly through the bed of grain in the drying chamber. A plurality of parallel, horizontal cooling air inlet ducts are provided at the bottom of the drying chamber for directing cooling air upwardly through the bed of grain and a plurality of exhaust ducts extend across the chamber intermediate the hot and cooling air inlet ducts to receive and exhaust air flowing from the inlet ducts.

The novel feature of the present invention has to do with the manner in which the wet grain is delivered from the receiving bin into the drying chamber. Thus, according to the invention the wet grain receiving bin has a horizontal floor assembly extending across the tower. This floor assembly has a plurality of uniformly spaced openings with a tube member extending downwardly beneath each of these openings. These tubes are fixed in position beneath the openings and serve to deliver wet grain in response to gravity from the bin into the drying chamber.

A hot air inlet duct is provided adjacent these tube members for delivering hot air into the space formed between the tube members and downwardly through the top of the bed of grain in the drying chamber. This space between the tube members serves as a hot air distributing zone within which the grain does not enter.

The drying chamber has a plurality of grain discharge outlets extending across the bottom and means are provided for withdrawing dry grain from these outlets at a controlled substantially continuous rate. As the grain level in the drying chamber is lowered by removal of the dry grain through the outlets, wet grain in response to gravity moves from the bin into the drying chamber.

However, with the system of delivery tubes according to the present invention, it has been found that a pulsating action is obtained in the flow through the tube members. Thus, rather than the grain flowing continuously down through these tubes, it only flows until their outlets are blocked by the level of the grain in the drying chamber. Between the tubes, the surface of this wet grain forms quite deep valleys with an angle of repose in the order of about 45°. This wet grain, which covers the entire area between the tubes, immediately comes into contact with the hot air in the zone between the tubes so that the surface is very quickly dried and as this quick drying occurs, the critical angle of repose changes so that a lateral flow of grain occurs. This lateral flow together with the shrinkage of the wet layer due to the quick drying and the downward movement of the entire grain bed, causes the grain level to quickly drop away from beneath each tube outlet. This sudden drop in the grain level causes a fresh flow of wet grain down the delivery tubes until the tube outlets are once again blocked. These cycles repeat at intervals of about 10 to 15 seconds so that this represents the maximum period of time during which the surface of the wet grain is in direct contact with the hot air in the zone between the tubes.

It is believed that as this wet top layer of grain reaches a certain level of dryness, it behaves much in the manner of a fluid bed with very active lateral flow of the grain occurring. This lateral flow effectively serves to distribute successive layers of wet grain in the drying zone while avoiding channelling of the grain within the drying zone.

The basic feature of the invention is the manner in which the wet grain delivery tubes distribute the wet grain in the drying chamber. Thus, they must be arranged such that during each pulsation, the layer of wet grain distributed covers the entire area of the drying chamber between the delivery tubes. If portions of partially dried grain are left exposed to the hot drying air, there is a danger of the grain being damaged from excess heat. Of course, the layer of cool, wet grain freshly distributed by the delivery tubes is capable of absorbing this heat without damage.

These wet grain delivery tubes can have a variety of different cross-sectional shapes, and can be of uniform dimensions, eg. round, square, hexagonal, etc. or they can be rectangular. In terms of avoiding wet grain remaining trapped beneath a delivery tube, they preferably have a minimum lateral dimension of no more than about 16 inches. More commonly they have a minimum lateral dimension of about 6 to 10 inches with square tubes being the most efficient. The rectangular tubes can be long and narrow, each extending entirely across the drying chamber or they can be arranged end to end in rows across the chamber.

The spacing of the tubes is also important so that a full layer of wet grain is distributed. Generally the spacing between tubes will be no more than two times the minimum lateral dimension of the tubes, with spacings approximately equal the minimum dimension being preferred. For instance, 8 inch square tubes spaced from each other by 8 inches give excellent results. Likewise, long tubes having a width of 6–8 inches and spaced from each other by about 6–8 inches also give very good results.

There is no limit in terms of closeness between tubes, but efficiency tends to decrease when they are closer than about 6 inches.

It has also been found to be desirable for the cross-sectional area of the openings in the floor of the bin to be somewhat less than the cross-sectional area of the tubes since this prevents any compacting of the grain within the tubes and permits immediate response to gravity of the wet grain within the tubes when a gap occurs between the bottom of the tubes and the level of the grain in the drying chamber.

With this system, the drying air is introduced at very high temperatures, e.g. in excess of 350° – 400° F and this means that the side walls of the delivery tubes must be insulated to avoid overheating of grain adjacent the walls of the tubes while it is contained within the tubes. In otherwords, the wet grain is subjected to the effects of the very hot drying air only during that brief period of time after which it has emerged from the tubes and has been delivered as a fresh layer in the drying chamber.

According to a preferred embodiment, the air exhaust system extending across the drying chamber intermediate the hot and cooling air inlet ducts is also in the form of a horizontal floor assembly extending across the chamber, this floor having a plurality of uniformly spaced openings of substantial uniform transfers dimensions and a tube member extending downwardly beneath each opening. The tube members are perforated and air exhaust openings are provided in a side wall of the chamber adjacent these perforate tube members.

Thus, the grain passes down through the tubes with the exhaust air passing through the perforations in the tube walls and into the zone between the tubes and thence out the exhaust openings.

Again in this case it is preferable for the cross-sectional area of the floor openings to be less than the cross-sectional area of the perforated tube members so that the grain is not compacted at the region where the actual separation of the exhaust air from the grain takes place.

According to another embodiment, a single blower unit is used for providing both the cooling air at the bottom of the drying chamber and the hot air at the top of the chamber. This can also be combined with a heat exchange system so that ambient air is heat exchanged with the exhaust air whereby the inlet air to the blower is warmed. One portion of the warm air emerging from the blower is then fed to the cooling air ducts at the lower end of the drying chamber while the other portion passes through a burner unit where it is heated to a temperature in excess of 400° F after which it is fed into the upper end of the drying chamber.

This heat exchange of the ambient air helps to minimize total heat loss in the system and the warmed ambient air is effective in providing some additional drying of the grain within the countercurrent flow section.

BRIEF DESCRIPTION OF THE DRAWINGS

Certain preferred embodiments of the invention are illustrated by the following drawings in which:

Referring to FIGS. 1 and 2, there is shown one embodiment of the dryer according to this invention. This includes a tower 10 constructed in a series of sections including frame members 11, sheet metal panels 12, a top 13 and a bottom 14. Within the tower is the floor assembly 15 according to the invention.

Figure 1:
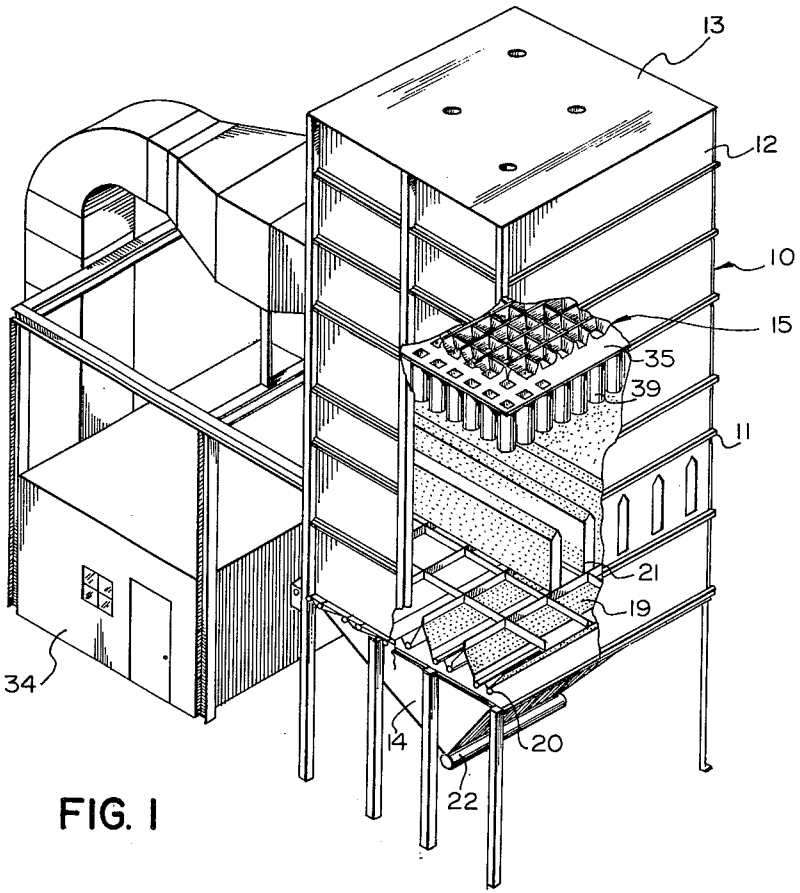
FIG. 1 is a perspective view of one embodiment of the invention.
Figure 2:
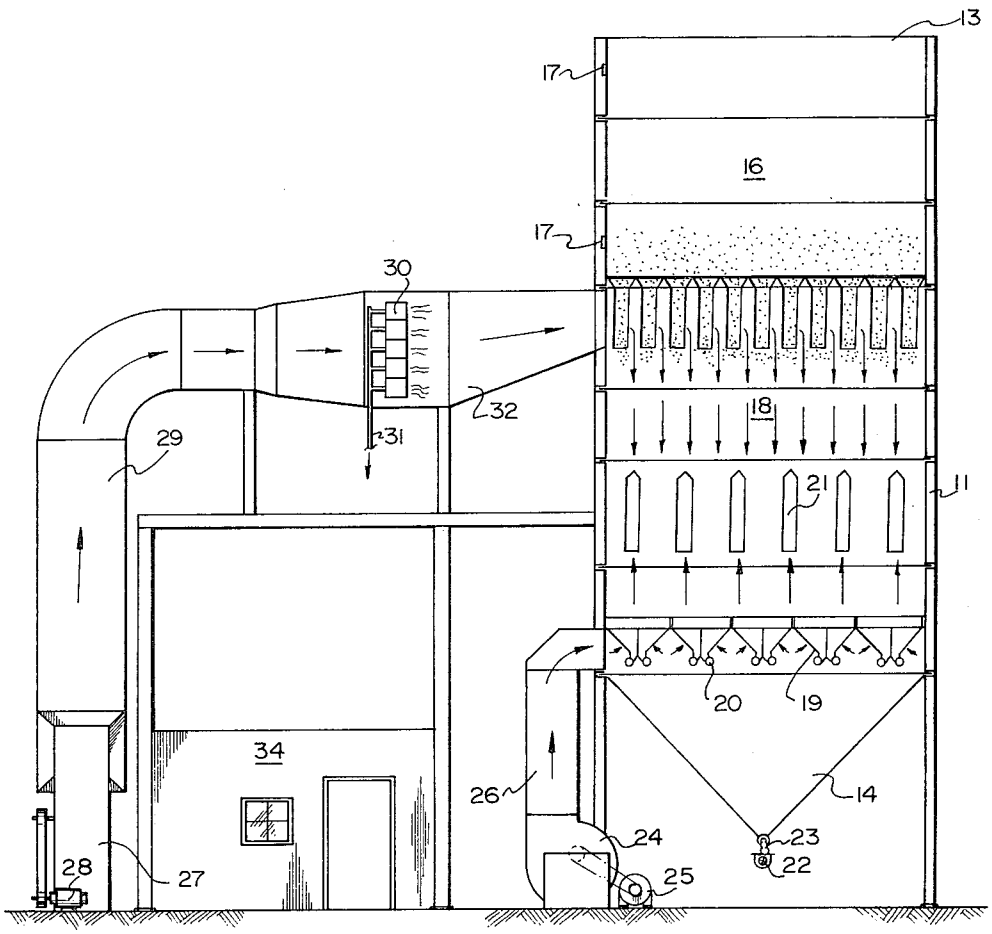
FIG. 2 is an elevation view of the system shown in FIG. 1.

Proceeding from the top of the tower, there is provided a wet grain holding bin 16 with low and high level indicators 17 for maintaining a proper level within the bin. The floor assembly 15 forms the bottom of bin 16 and beneath this floor assembly is the drying chamber 18. The bottom of this chamber is formed by a series of screens 19 which extend horizontal and parallel across the chamber. Between these screens 19 are dry grain outlets with metering discharge rollers 20. At a location intermediate the floor assembly 15 and the cold air inlets screens 19 are a series of horizontal, parallel, spaced exhaust screen units 21 through which exhaust air passes to the outside.

The bottom portion 14 is in the form of a dry grain receiving hopper at the bottom of which is a grain screw 22 for removing grain from the hopper and a rotary air lock 23.

Cool air is supplied to the bottom of the drying chamber through the screens 19 by way of blower unit 24 which is driven by an electric motor 25. The duct 26 connects the blower 24 to the screens 19.

Hot air is supplied to the upper end of the drying chamber by means of blower 27 and electric motor 28. This blower forces ambient air up the duct 29 and through burner unit 30 which is connected to a gas supply 31. Here the air is heated and the hot air is passed into the drying chamber by way of duct 32. The hot air supply system can conveniently be supported on a frame structure 33 which can also form a portion of the structure of a control room 34.

Figure 3:
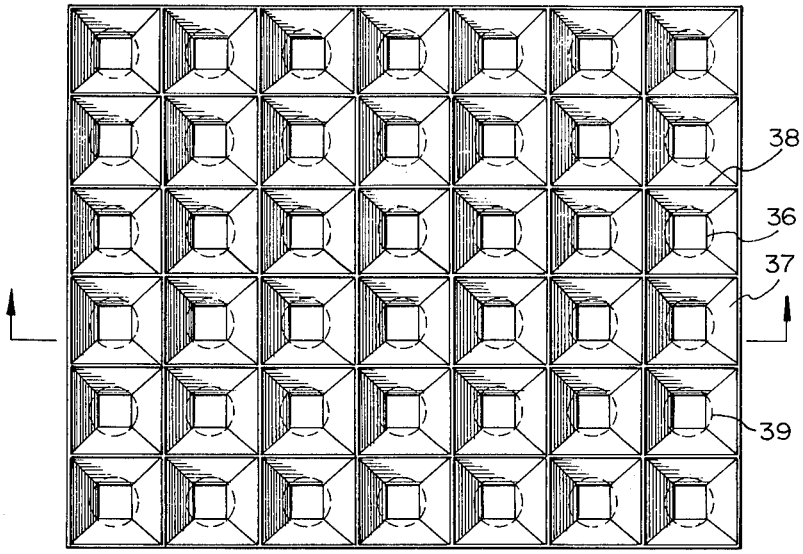
FIG. 3 is a top plan view of a floor assembly.
Figure 4:
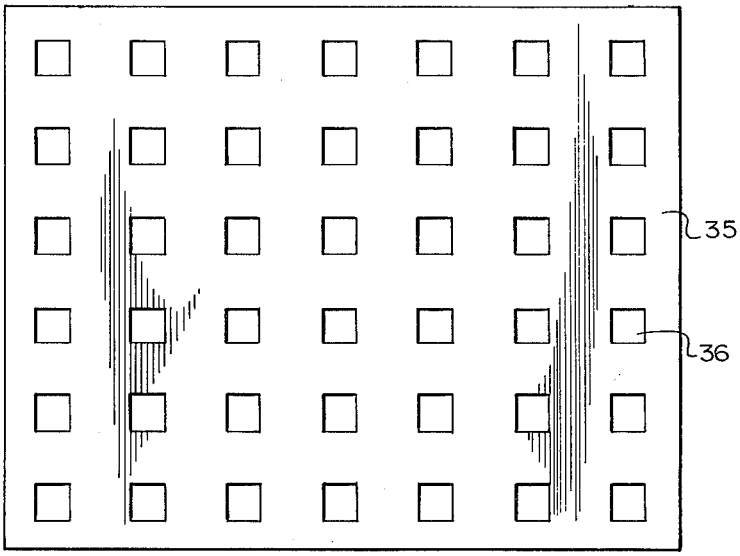
FIG. 4 is a bottom view of a floor assembly.
Figure 5:
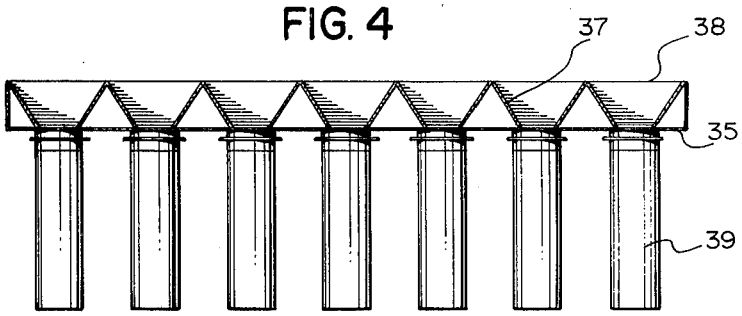
FIG. 5 is a side elevation of a floor assembly.

The contact of the wet grain with the hot drying air is carried out by means of the floor assembly 15 and this assembly can be seen in greater detail by reference to FIGS. 3, 4 and 5. From this it will be seen that the floor assembly includes a bottom plate member 35 with a series of equally spaced square openings 36. Extending upwardly and outwardly from the four edges of these holes are inclined panel members 37. The upper edges of panel members 37, of adjacent pairs of holes 36 are joined to form ridges 38. In this fashion the entire floor area is formed of inclined faces having an angle greater than the angle of repose of the wet grain. In this manner the floor is entirely self cleaning so that there is no necessity to remove any grain from the floor manually at the end of a run through the unit. Connected to the bottom of plate 35 beneath each hole 36 is a wet grain delivery tube 39. The outside of each delivery tube 39 is coated with an effective heat insulator such as SERA paper available from Johns Manville.

Figure 9A:
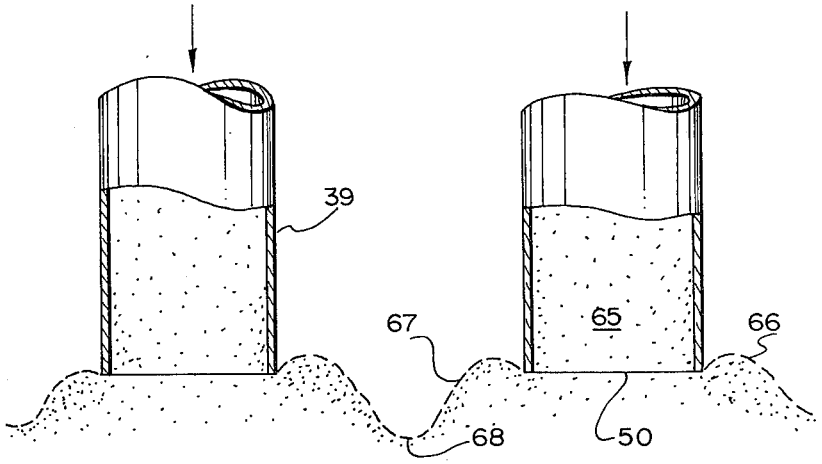
FIG. 9 illustrates, diagrammatically, an enlarged longitudinal section of the top of the grain bed in the dryer.

With this unit in operation, a level of grain, such as corn, is maintained in the bin 16, while in the drying chamber 18 the level of the grain is maintained in the region of the bottom end 50 of the tubes 39. This can be seen better from FIGS. 9A and 9B. When a space exists between the bottom end 50 of tube 39 and the level of the grain in the drying chamber, wet grain 65 flows out of the tube until the bottom end of the tube is blocked and no further flow occurs. At that point the surface of the grain has a configuration substantially as shown in FIG. 9A with a bead of grain 66 surrounding the tube and then being inclined downwardly at a relatively steep angle 67 dependent on the level of moisture within the grain. In this manner a valley is formed between the tubes 39 having a low point 68. With normal wet grain the incline 67 will be in order of about 45°.

Figure 9B:
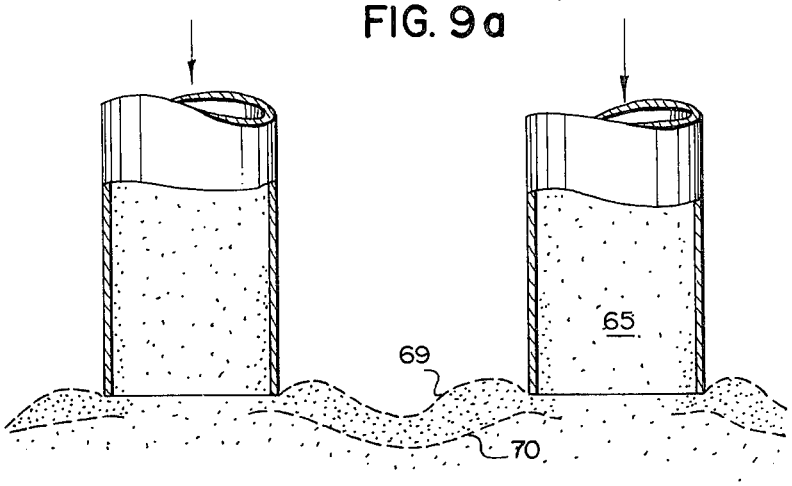

Of course, the area between the tubes 39 is receiving hot dry air having a temperature in excess of 400° F and the upper surface of the grain coming into contact with this air is very quickly superficially warmed and dried. This has the effect of quickly changing the characteristics of the grain and it commences to flow much in the manner of a fluid bed and flows into a much shallower valley 69 as shown in FIG. 9B. This results in a very rapid lateral movement of the grain and a uniform spreading of a layer of grain across the surface of the grain in the drying chamber.

At the same time the level of the bed in the drying chamber is steadily moving downwardly because of discharge of grain through the meter rolls 20 so that as the wet grain having the characteristics shown in FIG. 9A suddenly changes in characteristics, a gap is created beneath the ends of tubes 39 so that a fresh lot of wet grain 65 flows out to again form a surface pattern as shown in FIG. 9A. The cycle then repeats itself in this fashion with each repeat occuring about every 10 to 15 seconds.

The result is a very regular cyclic flow in which the wet grain is distributed from the tubes 39 onto the surface of the grain in the drying chamber in the form of thin uniform layers.

The hot air, of course, then continues downwardly through the bed in the drying chamber to provide a uniform degree of drying and exits through the tubular exhaust screens 21.

The cooling air which enters through screens 19 at the same time moves upwardly in countercurrent flow against the downward flow of heated, dried grain to provide a cooling and tempering effect and it also exits at the tubular discharge screens 21.

The dried and cooled grain is discharged through the metering rolls 20 into hopper 14 and is collected by way of grain screw 22.

Figure 6:
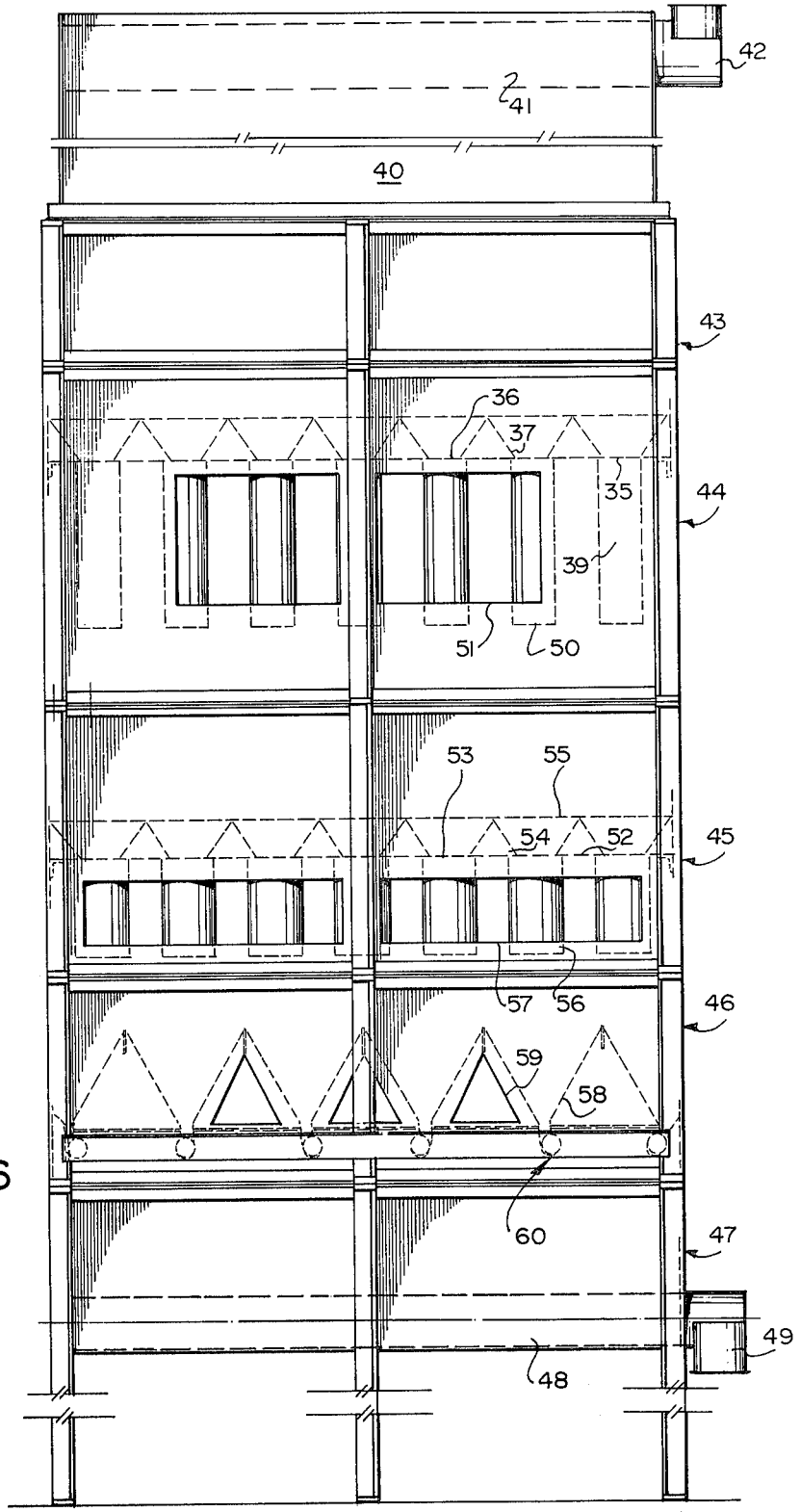
FIG. 6 is a side elevation of a further embodiment of the present grain dryer.
Figure 7:
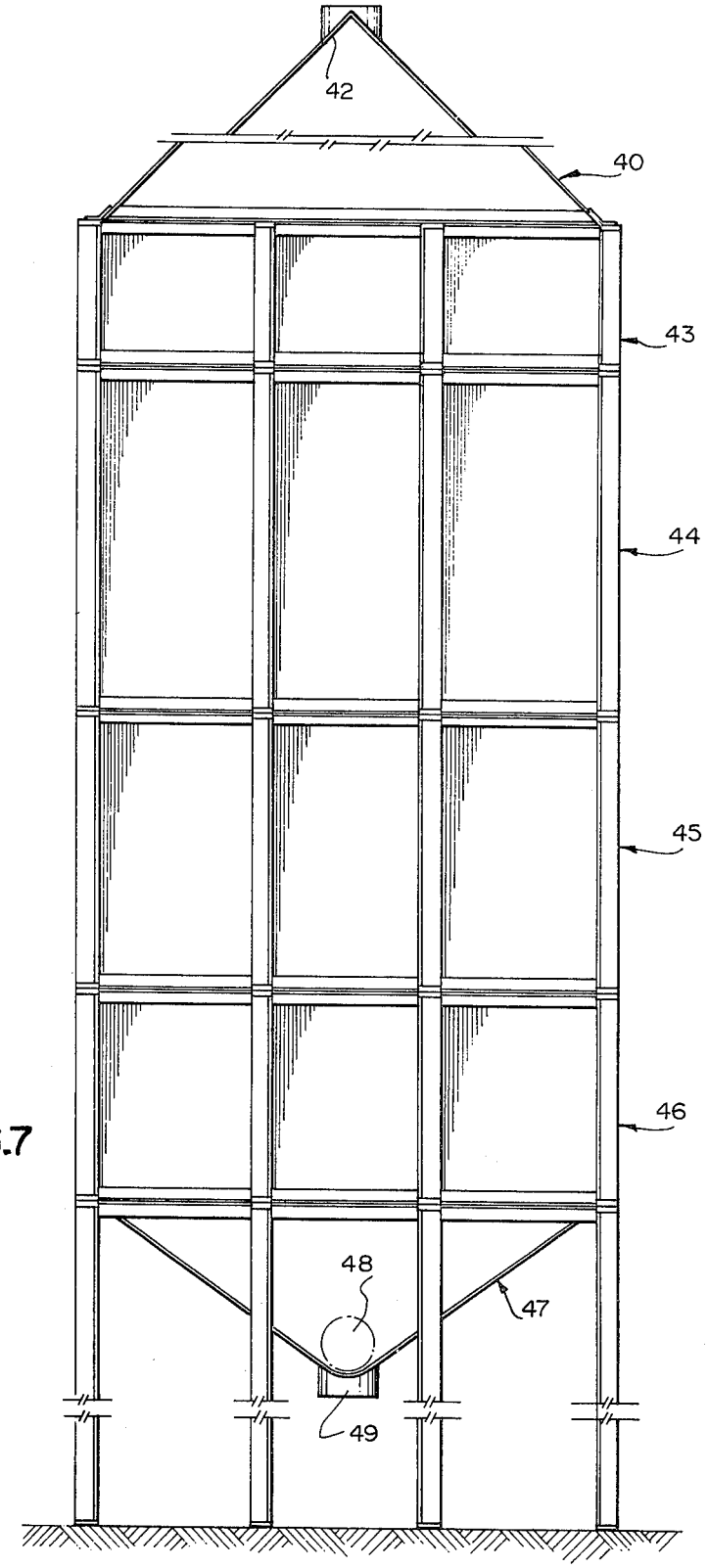
FIG. 7 is an end elevation of the device shown in FIG. 6.

Looking now at FIGS. 6 and 7 of the drawings, there is illustrated a particularly preferred commercial embodiment in which the air exhaust is also constructed in the form of a floor assembly with vertical tube members. In this embodiment the tower is constructed in the form of a series of sections or modules so that the internal portions of these sections or modules can be preassembled and delivered to the construction sight where they are simply stacked one on top of the other by means of a small crane.

Looking at a tower from the top, it includes a top section 40 with a grain infeed screw 41 which is connected to a rotary air lock 42. Beneath the top section 40 is a reserve hopper section 43, beneath which is positioned a drying chamber section 44. This drying chamber section contains a floor assembly of the type described hereinbefore in relation to FIGS. 3, 4 and 5 and a side wall of this section contains a pair of openings 51 for connection to ducts delivering hot drying air.

Mounted beneath the drying chamber is an exhaust section 45 and this contains an exhaust device which is similar in construction to the air input section of the drying chamber. Thus, it includes a floor unit having a floor panel 52 with a series of equally spaced square holes 53. Extending upwardly and outwardly from the edges of each hole are inclined panels 54, the upper edges of which join to form ridges 55. Thus, these form a self-cleaning floor of the type described in relation to FIGS. 3, 4 and 5. Extending downwardly beneath each hole in plate 52 is a perforated tube 56. The air passing through the grain exhausts through these perforations and out through openings 57 in the wall of the section.

Figure 8:
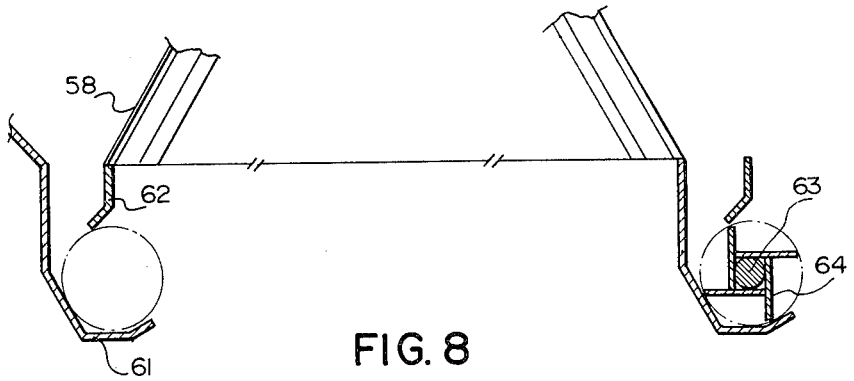
FIG. 8 is a detailed view of a grain discharge metering roll assembly.

Beneath the exhaust section 45 is a cooling section 46 and this contains a series of inclined screen sections 58 for delivering cool air into the bottom of the drying chamber with the cool air being supplied through openings 59. Between each pair of inclined screens 58 is a grain discharge opening containing a discharge metering roll 60. As can be seen in more complete detail in FIG. 8, each metering roll assembly is in the form of a substantially J-shaped plate 61 extending across the chamber and an upper angled deflector plate 62. Positioned within the J-shaped member is a metering roll having a rotatable shaft 63 to which is fixed a series of blades 64 serves to substantially continuously discharge dry grain from the drying chamber. This dry grain is received in discharge hopper section 47 which is mounted beneath the cooling grain section 46 and this hopper has at the bottom a grain discharge tube 48 which is connected to a rotary air lock 49.

Figure 10:
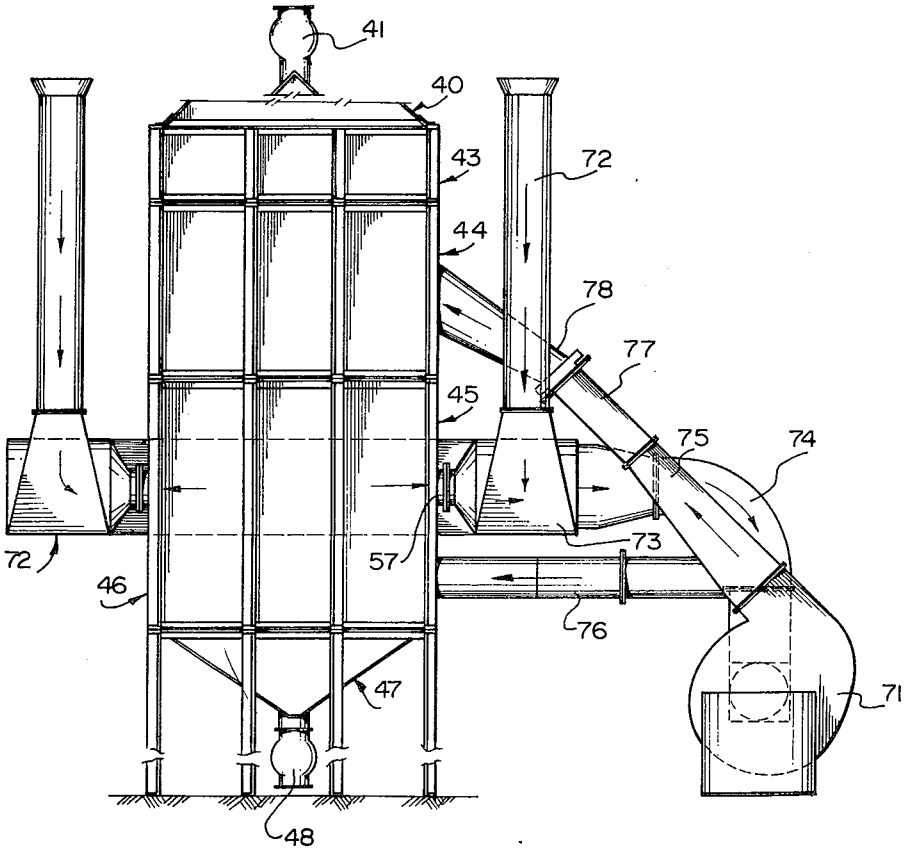
FIG. 10 is an elevation showing a waste heat recovery system.

A preferred system for supplying air to the dryer is shown in FIG. 10. This includes a single blower unit 71 which can be powered by either an electric motor or internal combustion engine, etc. The input air to the blower 71 is obtained from the ambient air through tubes 72 but this air before entering the blower 71 is preheated by means of heat exchange with the exhaust air from the tower. Thus, the exhaust air passes out through opening 57 and through heat exchanger 73 where some of the heat contained in the exhaust air is used to preheat the air entering through tube 72. This preheated air passes into the blower through duct 74.

The air emerging from the blower is in two sections with one section 75 going to the drying chamber 44 and the other section 76 going to the cooling section 46. The air travelling through duct 75 passes through burner 77 where it is heated to an excess of 400° F and then proceeds through duct 78 and through air inlet 51 into the drying chamber.

The above detailed description shows the most preferred embodiment of the invention where the wet grain delivery tubes are of uniform transverse dimensions i.e. preferably square or round. While that arrangement represents the most efficient grain drying method embodying the invention, very good results can also be obtained with other configurations of the wet grain delivery tubes.

Figure 11:
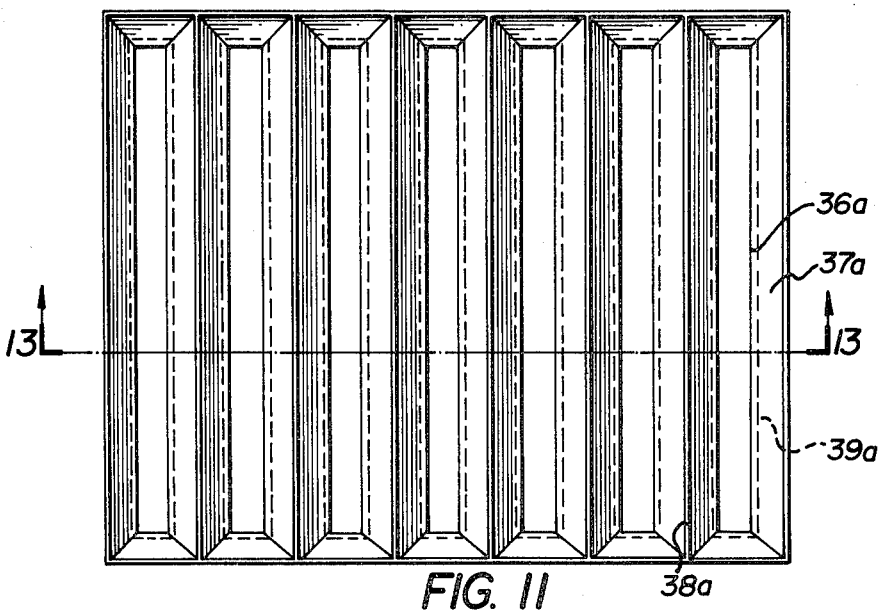
FIG. 11 is a top plan view of a second embodiment of the floor assembly.
Figure 12:
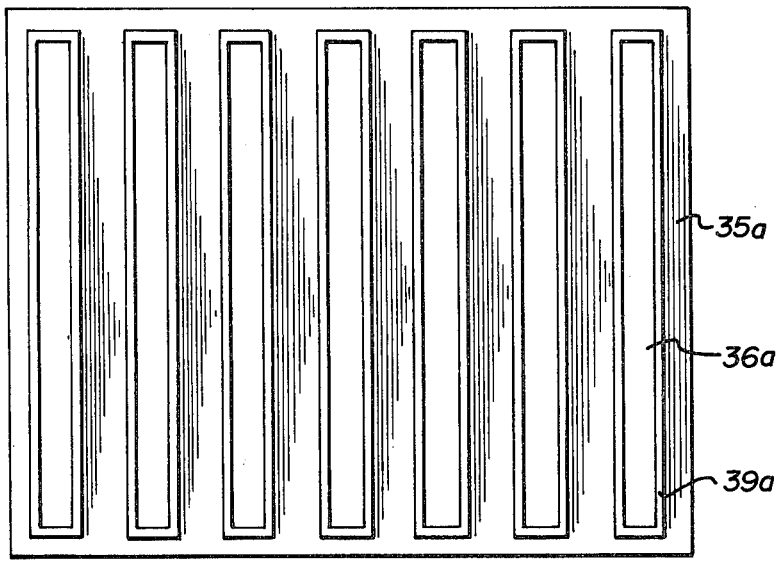
FIG. 12 is a bottom view of the floor of FIG. 11.
Figure 13:
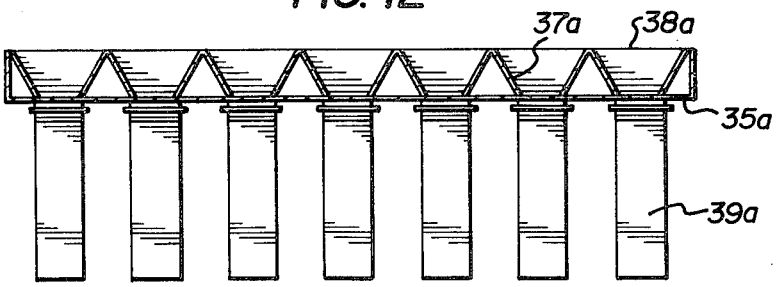
FIG. 13 is a side elevation of the floor assembly of FIG. 11.

For example, each wet grain delivery tube can be long and narrow, extending across substantially the entire drying chamber. Such an arrangement is illustrated by FIGS. 11, 12 and 13. From this it will be seen that the floor assembly includes a bottom plate member **35*a* with a series of equally spaced long narrow openings 36*a*. Extending upwardly and outwardly from the four edges of these holes are inclined panel members 37*a*. The upper edges of the panel members 37*a*, of adjacent pairs of holes 36*a*, are joined to form ridges 38*a*. Connected to the bottom of plate 35*a* beneath each hole 36*a* is a wet grain delivery tube 39*a***.

This floor assembly functions in the same manner as the assembly described hereinbefore, the only difference being that this floor assembly is less efficient in terms of grain drying because the wet grain emerging from the bottom of the wet grain delivery tubes is not as uniformly distributed into the area between the delivery tubes where it comes into contact with the hot drying air. However, it is still superior to systems presently on the market and fully incorporates the unique feature of the present invention.

Figure 14:
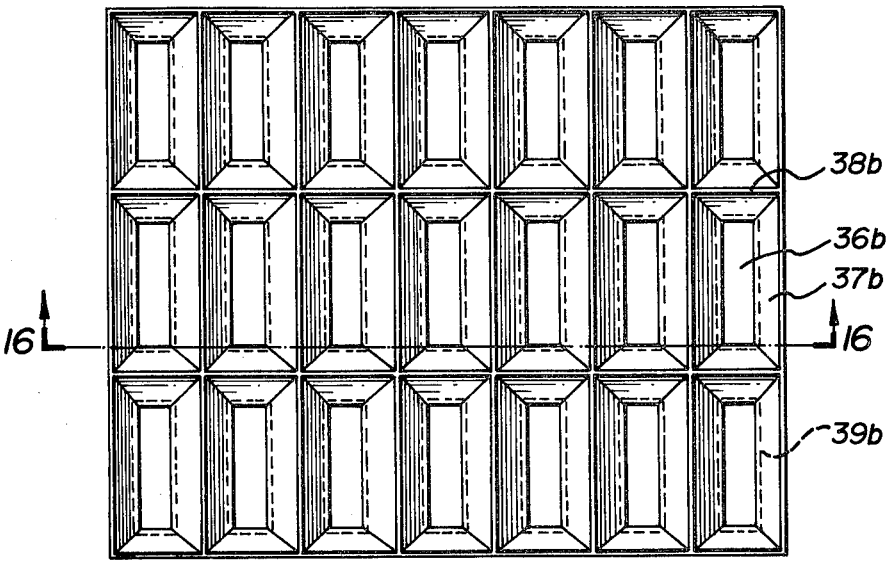
FIG. 14 is a top plan view of a third embodiment of the floor assembly.
Figure 15:
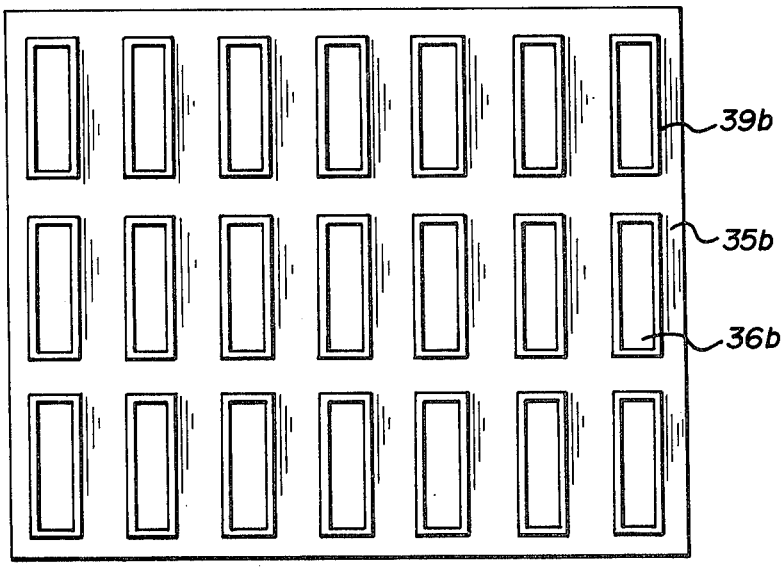
FIG. 15 is a bottom view of the floor of FIG. 14.
Figure 16:
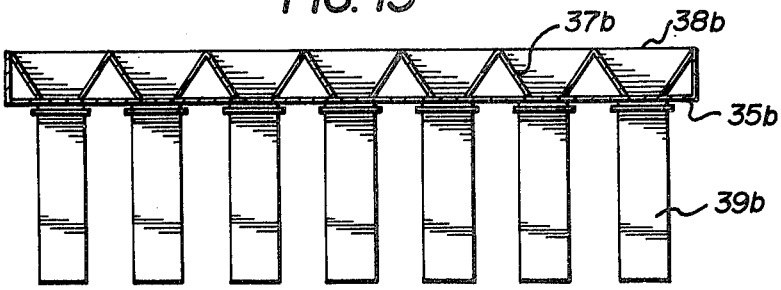
FIG. 16 is a side elevation of the floor assembly of FIG. 14.

FIGS. 14, 15 and 16 illustrate yet another embodiment of the floor assembly. In this embodiment a series of wet grain delivery tubes are utilized which are rectangular in transverse dimensions but are shorter than the ones shown in FIGS. 11, 12 and 13. Thus, it will be seen that these rectangular delivery tubes are arranged in parallel rows with the floor assembly including a bottom plate member **35*b* with a series of equally spaced rectangular openings 36*b*. Extending upwardly and outwardly from the four edges of each of these holes are inclined panel members 37*b*. The upper edges of panel members 37*b* of adjacent pairs of holes 36*b* are joined to form ridges 38*b*. Connected to the bottom of plate 35*b* beneath each hole 36*b* is a wet grain delivery tube 39*b***.

Because of the shorter length of the delivery tubes in transverse cross-section as compared with those of FIGS. 10 to 12, the wet grain distribution is better and therefore the drying is more efficient as compared with the embodiment of FIGS. 10 to 12 but still not as good as the embodiment of FIGS. 1 to 9.

EXAMPLE (a) Tests were conducted on a dryer as described in FIGS. 1–9 having 8 inch square delivery tubes at 8 inch spacings. The tower was 15 feet by 15 feet.

Wet corn at a moisture content of 26% was passed through the dryer at a rate of 1500 bu/hr and hot drying air was introduced at about 350°–380° F. The moisture content was reduced to 15% without heat damage to the corn. The heat requirement to achieve this degree of drying was about 1700 BTU per pound of water removed, with the total air circulation requiring 225 HP.

(b) The same type of wet corn being dried by a dryer of the general type described in U.S. Pat No. 3,710,449 required about 3000 BTU/pound of water removed to dry to about 15% moisture.

Thus it will be seen that the present invention not only produced a dried product of excellent quality, but does so with great fuel economy as compared with the prior art.

I claim as my invention:

1. A concurrent-countercurrent flow grain dryer comprising a tower with side walls, a top and a bottom, said tower having a wet grain receiving bin at the top, said bin having a horizontal floor assembly extending across between the side walls of the tower, said floor assembly having a plurality of substantially uniformly spaced openings extending over substantially the entire floor assembly with a wet grain delivery tube member fixed beneath each said opening, the tube members having substantially uniform transverse dimensions and being spaced from each other a distance no greater than twice the said transverse dimensions and serving to deliver wet grain in response to gravity from said receiving bin into a drying chamber located in the tower beneath the bin, said drying chamber having a plurality of grain discharge outlets extending across the bottom thereof and means for withdrawing dry grain from said grain outlets at a controlled rate, a hot air inlet duct adjacent said tube members adapted to deliver hot air into the spaces between said tube members and downwardly through a bed of grain in said drying chamber, cooling air inlet ducts extending across the bottom of said drying chamber for directing cooling air upwardly through the bed of grain, exhaust ducts extending across said chamber intermediate said hot and cooling air inlet ducts to receive and exhaust air flowing from said hot inlet duct in a concurrent direction to grain flow and to receive and exhaust cooling air flowing from said cooling air inlet ducts in a countercurrent direction to grain flow, and means for providing hot air to said hot air inlet duct and cooling air to said cooling air inlet ducts, said tube members being of a size and spacing from each other such that the wet grain is delivered through the tube members into the drying chamber with a pulsating action and the wet grain flowing into the drying chamber forms a layer over the entire area between the tube members during each pulsation.

2. A concurrent-countercurrent flow grain dryer comprising a tower with side walls, a top and a bottom, said tower having a wet grain receiving bin at the top, said bin having a horizontal floor assembly extending across between the side walls of the tower, said floor assembly having a plurality of substantially uniformly spaced openings extending over substantially the entire floor assembly with a wet grain delivery tube member fixed beneath each said opening, each said tube member having heat insulating side walls and, serving to deliver wet grain in response to gravity from said receiving bin into a drying chamber located in the tower beneath the bin, said drying chamber having a plurality of grain discharge outlets extending across the bottom thereof and means for withdrawing dry grain from said grain outlets at a controlled rate, a hot air inlet duct adjacent said tube members adapted to deliver hot air into the spaces between said tube members and downwardly through a bed of grain in said drying chamber, cooling air inlet ducts extending across the bottom of said drying chamber for directing cooling air upwardly through the bed of grain, exhaust ducts extending across said chamber intermediate said hot and cooling air inlet ducts to receive and exhaust air flowing from said hot inlet duct in a concurrent direction to grain flow and to receive and exhaust cooling air flowing from said cooling air inlet ducts in a countercurrent direction to grain flow, and means for providing hot air to said hot air inlet duct and cooling air to said cooling air inlet ducts, the improvement which comprises wet grain delivery tube members having substantially equal transverse dimensions of no more than about 16 inches, said tube members being spaced from each other a distance no greater than twice the said transverse dimensions.

3. A grain dryer according to claim 2 wherein the distance between the tubes is approximately equal to the transverse dimensions of said tubes.

4. A grain dryer according to claim 3 wherein said wet grain delivery tube members each have an average cross dimension of about 6–10 inches.

5. A grain dryer according to claim 3 wherein the floor openings have a smaller cross-sectional area than the tube members.

6. A grain dryer according to claim 5 wherein the openings are square.

7. A grain dryer according to claim 5 wherein the wet grain delivery tube members are square in cross-section.

8. A grain dryer according to claim 6 wherein inclined panel members extend upwardly and outwardly from the edges of each square hole forming funnel-shaped entries, with the upper edges of the panels of adjacent holes being joined to each other to form ridges, whereby the floor assembly is self-cleaning.

9. A concurrent-countercurrent flow grain dryer comprising a tower with side walls, a top and a bottom, said tower having a wet grain receiving bin at the top, said bin having a horizontal floor assembly extending across between the side walls of the tower, said floor assembly having a plurality of substantially uniformly spaced openings extending over substantially the entire floor assembly with a wet grain delivery tube member fixed beneath each said opening, the tube members being rectangular in transverse cross-section and spaced from each other a distance no greater than twice the width of each tube and serving to deliver wet grain in response to gravity from said receiving bin into a drying chamber located in the tower beneath the bin, said drying chamber having a plurality of grain discharge outlets extending across the bottom thereof and means for withdrawing dry grain from said grain outlets at a controlled rate, a hot air inlet duct adjacent said tube members adapted to deliver hot air into the spaces between said tube members and downwardly through a bed of grain in said drying chamber, cooling air inlet ducts extending across the bottom of said drying chamber for directing cooling air upwardly through the bed of grain, exhaust ducts extending across said chamber intermediate said hot and cooling air inlet ducts to receive and exhaust air flowing from said hot inlet duct in a concurrent direction to grain flow and to receive and exhaust cooling air flowing from said cooling air inlet ducts in a countercurrent direction to grain flow, and means for providing hot air to said hot air inlet duct and cooling air to said cooling air inlet ducts, said tube members being of a size and spacing from each other such that the wet grain is delivered through the tube members into the drying chamber with a pulsating action and the wet grain flowing into the drying chamber forms a layer over the entire area between the tube members during each pulsation.

10. A grain dryer according to claim 9 wherein the tube members have a transverse cross-section of substantial length relative to width and have a width of up to about 16 inches.

11. A grain dryer according to claim 10 wherein the tube members have a width of about 6–10 inches.

12. A grain dryer according to claim 11 wherein the tube members are spaced from each other a distance approximately equal to the width of each tube.

13. A grain dryer according to claim 12 wherein each tube member extends substantially across the entire drying chamber.

* * * * *